US007927081B2

(12) United States Patent
MacNeil

(10) Patent No.: US 7,927,081 B2
(45) Date of Patent: Apr. 19, 2011

(54) PUMP AND MOTOR ARRANGEMENT

(75) Inventor: Daniel J. MacNeil, Barrie (CA)

(73) Assignee: MacNeil Wash Systems Limited (CA)

( * ) Notice: Subject to any disclaimer, the term of this patent is extended or adjusted under 35 U.S.C. 154(b) by 148 days.

(21) Appl. No.: 11/276,705

(22) Filed: Mar. 10, 2006

(65) Prior Publication Data

US 2007/0212235 A1 Sep. 13, 2007

(51) Int. Cl.
*F04B 17/00* (2006.01)
*F04B 35/00* (2006.01)

(52) U.S. Cl. ..... 417/361; 417/362; 417/423.14; 417/423.15

(58) Field of Classification Search ..... 417/361, 417/362, 343, 359, 424.1, 424.2, 360, 423.14, 417/423.15; 474/115, 117, 94, 114; 248/639, 248/662; 74/89.2, 89.21, 89.22, 103, 108
See application file for complete search history.

(56) References Cited

U.S. PATENT DOCUMENTS 1,970,681 A * 8/1934 Zimmerer ..... 210/136
2,010,062 A * 8/1935 Dawson ..... 141/95
2,036,098 A * 3/1936 Pieper et al. ..... 137/565.18
2,187,684 A * 1/1940 Fox et al. ..... 222/385
2,251,868 A * 8/1941 Eckert ..... 417/390
2,335,508 A * 11/1943 Gustafsson et al. ..... 415/220
2,398,520 A * 4/1946 Clements ..... 92/83
2,833,597 A * 5/1958 Sloyan ..... 384/38
2,874,006 A * 2/1959 Sloyan ..... 384/29
3,064,486 A * 11/1962 Aplin ..... 474/37
3,421,724 A * 1/1969 Cornell ..... 248/657
3,872,801 A * 3/1975 Weddendorf ..... 186/57
3,961,865 A 6/1976 Spaulding
4,012,021 A * 3/1977 Duceppe ..... 248/651
4,341,506 A * 7/1982 Klein ..... 417/362
4,344,598 A * 8/1982 Sloyan ..... 248/651
4,561,624 A * 12/1985 Freeman ..... 248/639
4,594,056 A 6/1986 Brunner
4,595,368 A * 6/1986 Cole ..... 434/234
4,600,368 A * 7/1986 Sommer ..... 417/378
4,826,469 A * 5/1989 Cooley ..... 474/101
4,877,984 A 10/1989 Colwell et al.
5,201,638 A 4/1993 Bieri
5,378,119 A * 1/1995 Goertzen ..... 417/313
5,441,390 A 8/1995 Rapp et al.
6,004,112 A * 12/1999 Cook et al. ..... 417/362

* cited by examiner

*Primary Examiner* — Devon C Kramer
*Assistant Examiner* — Amene S Bayou
(74) *Attorney, Agent, or Firm* — Barnes & Thornburg LLP

(57) ABSTRACT

A pump station comprising includes a motor and pump arrangement, a tank for holding a liquid; and a frame for supporting the tank generally above the motor and pump arrangement. The motor and pump arrangement includes a motor having a drive shaft rotatable about a first longitudinal axis and a pump having a drive shaft rotatable about a second longitudinal axis oriented parallel to the first longitudinal axis. A drive mechanism interconnects the drive shaft of the motor and the drive shaft of the pump. A mounting assembly is provided and includes a lower portion mounted to a portion of one of the motor and the pump; and an upper portion to which the other of the motor and the pump is mounted. The lower portion and the upper portion are configured and selectively movable in such a manner that the drive shaft of the motor and the drive shaft of the pump, during translation movement relative to each other, are constrained from rotational movement relative to each other.

12 Claims, 14 Drawing Sheets

PUMP AND MOTOR ARRANGEMENT

FIELD OF INVENTION

This invention relates to motor and pump arrangements.

BACKGROUND

Pumps often need a separate drive motor. Arrangements for mounting a pump and a motor in spaced relation to each other, so the motor can drive the pump, are well known. Often the pump and motor are mounted to separate support frames or to a common support frame.

One general type of pump and motor arrangement provides for the drive shaft of a motor to be interconnected with the drive shaft of a pump, where the drive shafts of both are arranged with their axes of rotation positioned in spaced parallel relation to each other, with the ends of the shafts pointed in the same axial direction. One pulley is mounted on the end of the motor drive shaft and another pulley is mounted on the end of the pump shaft. Rotation of the drive shaft of the motor is transmitted by interconnection of the two pulleys such as by a belt or chain.

To permit adjustment or replacement of the belt or chain, it is usually necessary to be able to adjust the spacing between the two shafts. In known adjustment mechanisms, this adjustment and/or replacement is facilitated by allowing at least one of the pump and motor to be movable relative to the other, so that the pulleys can be moved toward or apart from each other. Of course the tension in the belt, can also be controlled by the spacing apart of the shafts and their associated pulleys. A drawback of this arrangement is that such a mechanism, which allows for the adjustment may, during operation of the motor and pump, result in the mis-alignment of the shafts, due to slippage within the adjustment mechanism. This mis-alignment of the shafts can occur both as one or both of the pump and motor rotate relative to their original aligned positions. Aside from rotation, it can also occur if the motor and/or pump have translation movement in other than the direction of the plane passing through the intersection of the axes of both shafts. This translation movement may include one of the motor and pump moving axially relative to the other.

It will be appreciated that in particular, a misalignment can result from the tension in the interconnecting belt or chain as the pulleys and shafts are pulled towards each other but not in such a manner that the axes of the shafts of the motor and pump remain parallel to each other, or remain in the plane passing through the intersection of the axes of both shafts in their desired positions.

Pump and motor arrangements are used in vehicle wash systems, such as for example car wash systems. These pump and motor arrangements can be supplied as part of a pump station, which is used to pump a liquid such as water, soap, and other vehicle treatment liquids into a suitable location in the vehicle wash system. Often vehicle wash systems will have several similar pump stations. In known pump stations for car wash systems, the pump and motor are positioned in side-by-side relation. In addition to the drawbacks mentioned above, they also have a relatively large footprint. In the business premises where vehicle wash systems are located, space is often limited. Therefore, providing a relatively small footprint for each pump station is desirable.

Accordingly, an improved pump and motor arrangement is desirable.

SUMMARY OF THE INVENTION

According to one aspect of the invention there is provided a motor and pump arrangement comprising: a motor having a drive shaft rotatable about a first longitudinal axis; a pump having a drive shaft rotatable about a second longitudinal axis oriented parallel to the first longitudinal axis; a drive mechanism interconnecting the drive shaft of the motor and the drive shaft of the pump; a mounting assembly comprising a lower portion mounted to a front face portion of one of the motor and the pump; an upper portion to which the other of the motor and the pump is mounted, the lower portion and the upper portion being selectively movable relative to each other only in a translation direction that is orthogonal to the direction of the first and second axis, and the upper and lower portions being restrained from any rotational movement relative to each other.

According to another aspect of the invention there is provided a motor and pump arrangement comprising: a motor having a drive shaft rotatable about a first longitudinal axis; a pump having a drive shaft rotatable about a second longitudinal axis oriented parallel to the first longitudinal axis; a drive mechanism interconnecting the drive shaft of the motor and the drive shaft of the pump; a mounting assembly comprising: a lower portion mounted to a portion of one of the motor and the pump; an upper portion to which the other of the motor and the pump is mounted; the lower portion and the upper portion being configured and selectively movable in such a manner that the drive shaft of the motor and the drive shaft of the pump during translation movement relative to each other, are constrained from rotational movement relative to each other.

According to another aspect of the invention there is provided a pump station comprising: a motor and pump arrangement comprising: a motor having a drive shaft rotatable about a first longitudinal axis; a pump having a drive shaft rotatable about a second longitudinal axis oriented parallel to the first longitudinal axis; a drive mechanism interconnecting the drive shaft of the motor and the drive shaft of the pump; a mounting assembly comprising: a lower portion mounted to a portion of one of the motor and the pump; an upper portion to which the other of the motor and the pump is mounted; the lower portion and the upper portion being configured and selectively movable in such a manner that the drive shaft of the motor and the drive shaft of the pump during translation movement relative to each other, are constrained from rotational movement relative to each other; a tank for holding a liquid; and a frame for supporting the tank generally above the motor and pump arrangement.

BRIEF DESCRIPTION OF THE DRAWINGS

In drawings which illustrate by way of example only, embodiments of the invention:P

DETAILED DESCRIPTION

Figure 1:
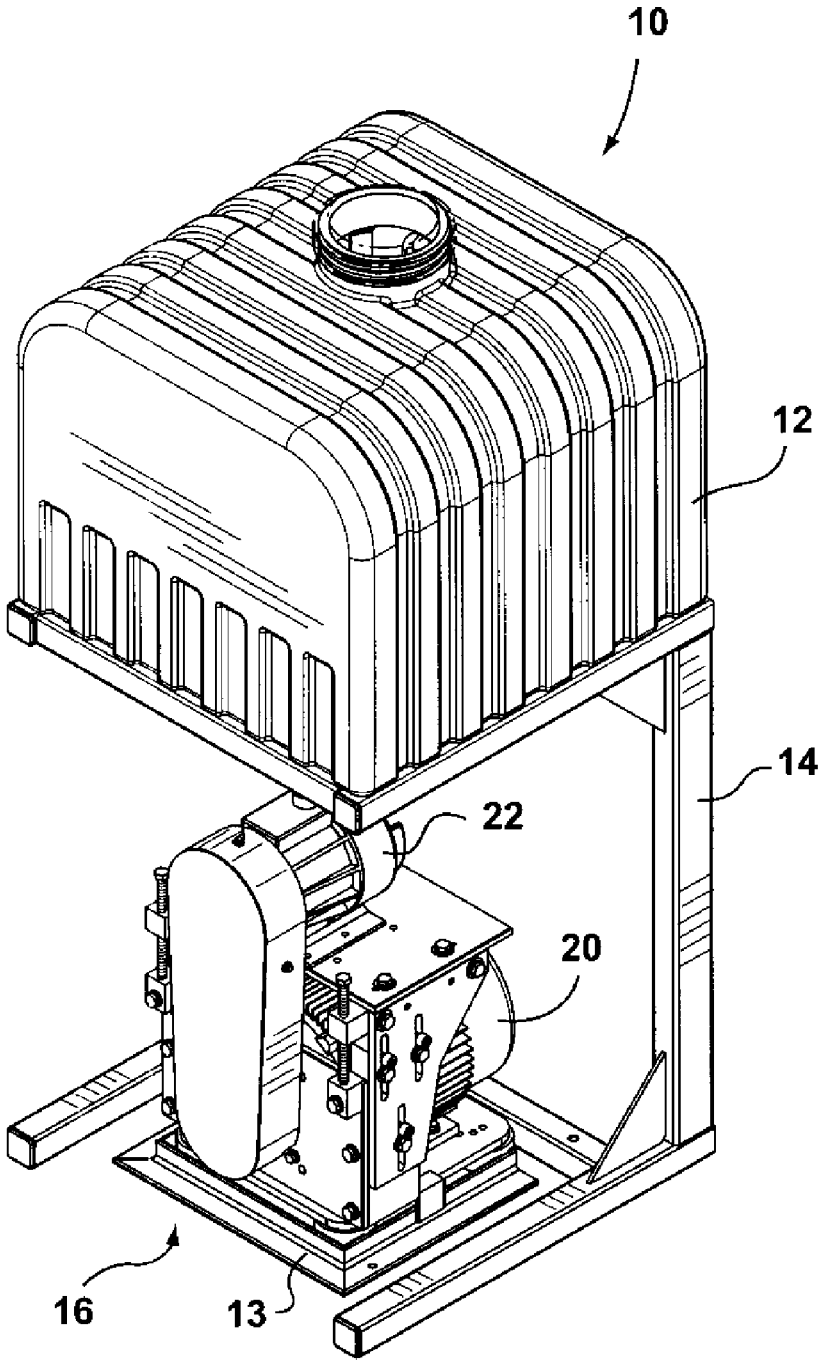
FIG. 1 is perspective view of a motor and pump station in accordance with an embodiment of the invention.

With reference to FIG. 1, a pump station generally designated 10 may be employed in a vehicle wash system such as the vehicle wash systems made by MacNeil Wash Systems Limited. Pump station 10 may include a liquid tank 12, a tank support frame 14 and a pump/motor arrangement 16. Tank 12 is suitable for holding a liquid which may be fed (such as by a gravity assisted feed) through piping (not shown) to the pump/motor arrangement 16, where the liquid can be pumped by the pump 22 through suitable piping to a desired location in a vehicle wash system (not shown) where the liquid is required, and may be ejected into the vehicle wash system at a high pressure. In other embodiments, the pump/motor arrangement may be configured to pump a gas such as air.

Pump/motor arrangement 16 may be held in a fixed position relative to tank support frame 14, for example by interconnecting the pump/motor arrangement to the support frame 14 in a manner not shown. The pump/motor arrangement 10 may include a motor 20 and a pump 22.

Figure 3:
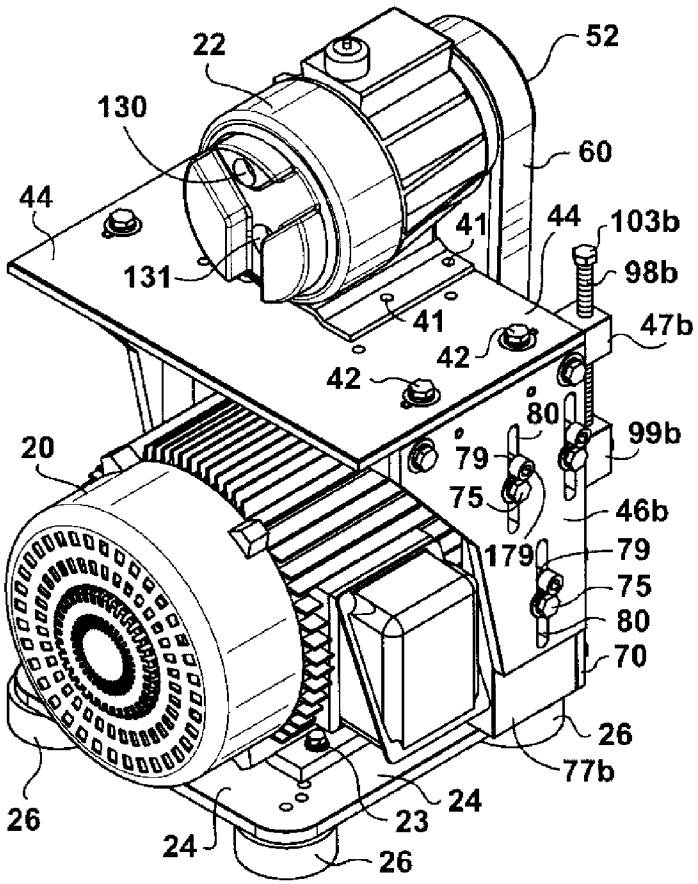
FIG. 3 is a rear perspective view of the assembly of FIG. 2.
Figure 2:
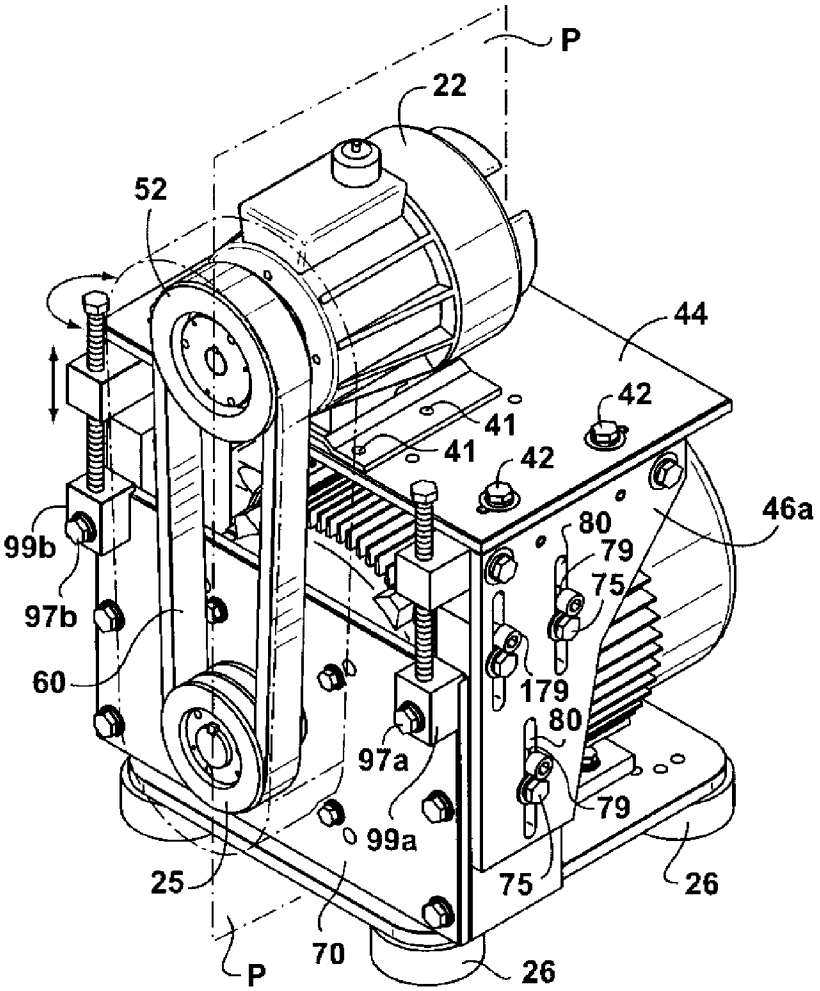
FIG. 2 is a front perspective view of the motor and pump assembly of FIG. 1.
Figure 4:
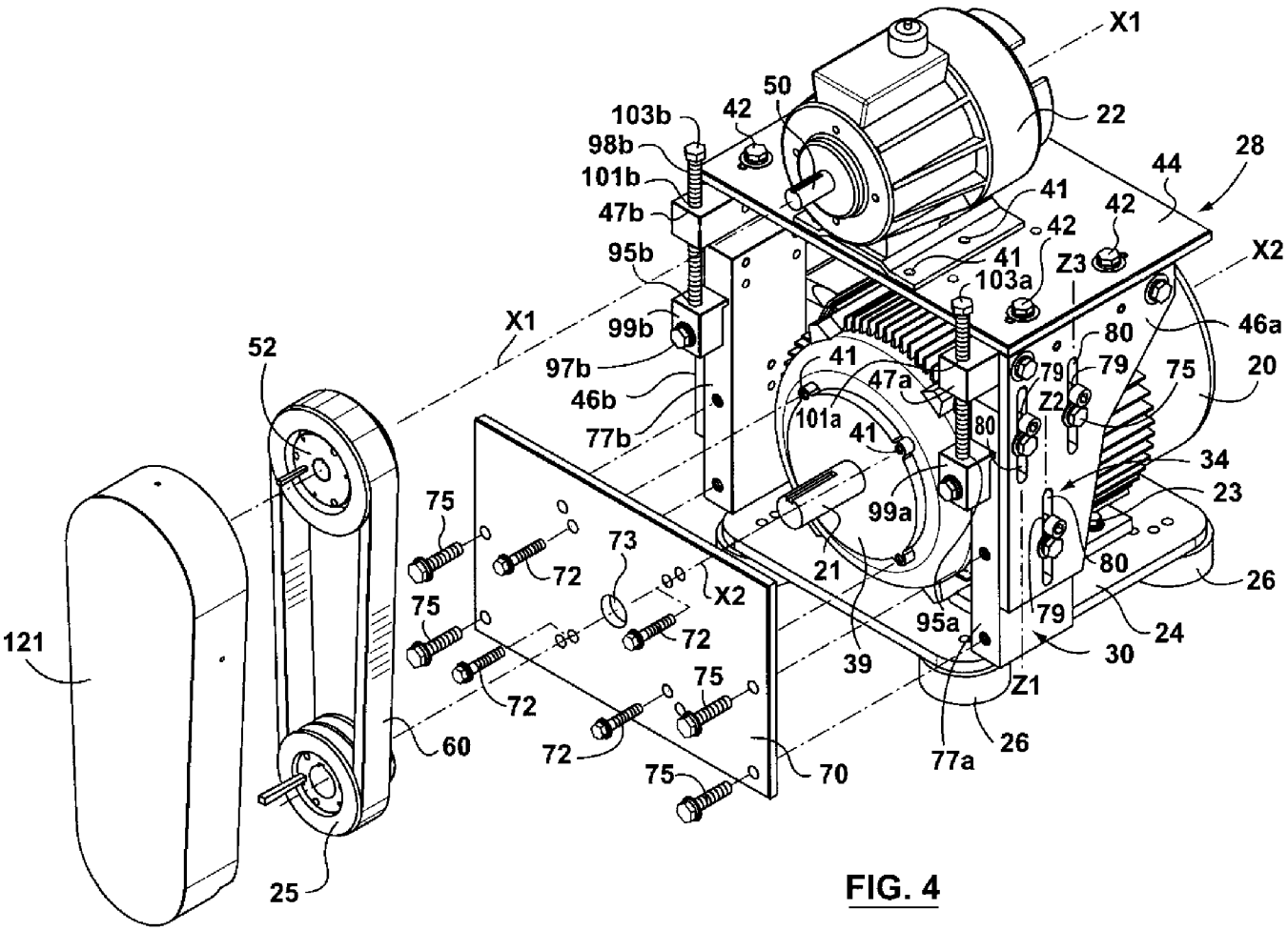
FIG. 4 is a front exploded perspective view of the assembly of FIGS. 2 and 3.
Figure 6:
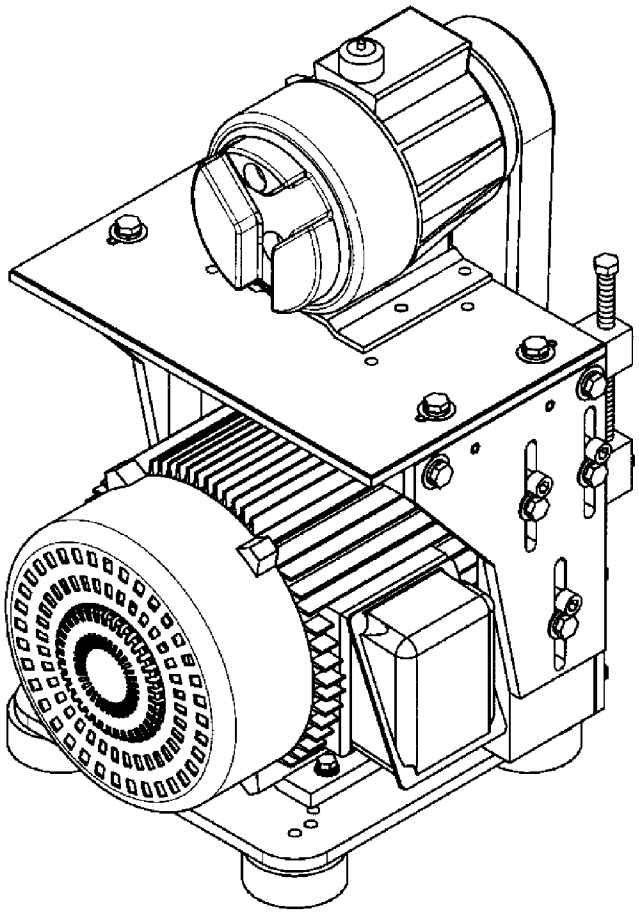
FIG. 6 is a rear perspective view of the assembly of FIG. 5
Figure 5:
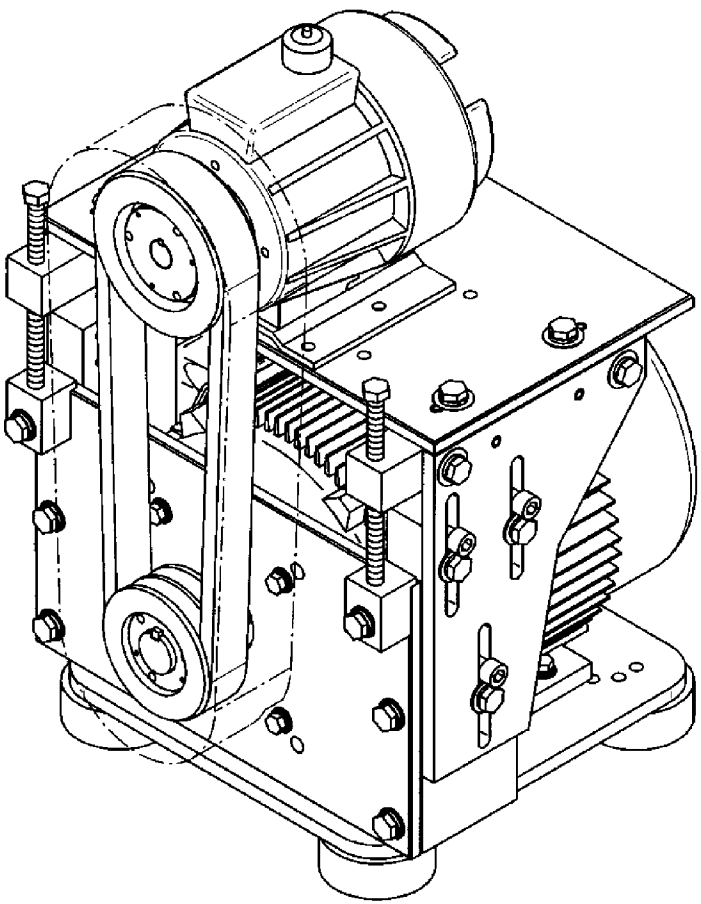
FIG. 5 is a front perspective view of the motor and pump assembly of FIG. 1.
Figure 8:
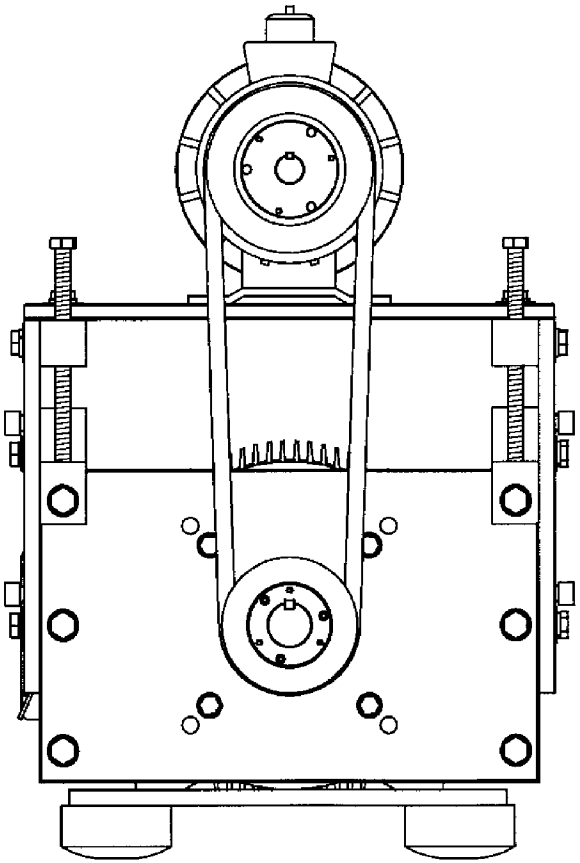
FIG. 8 is a front view of the assembly of FIG. 5.
Figure 7:
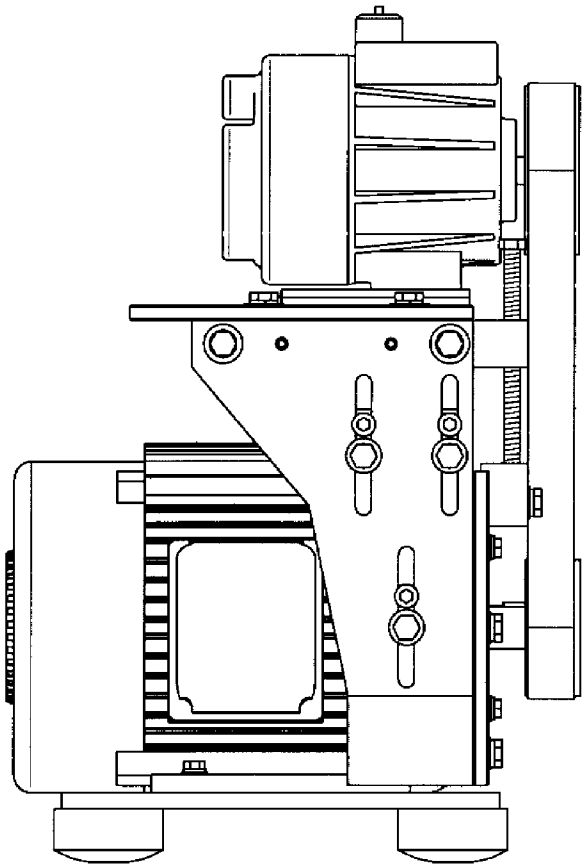
FIG. 7 is left side view of the assembly of FIG. 5.
Figure 10:
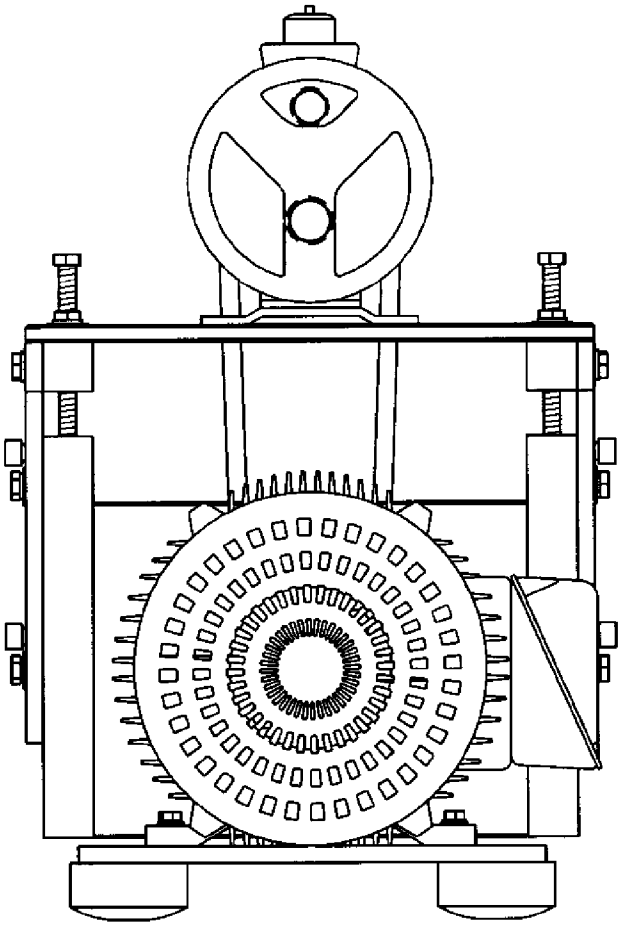
FIG. 10 is a rear view of the assembly of FIG. 5.
Figure 9:
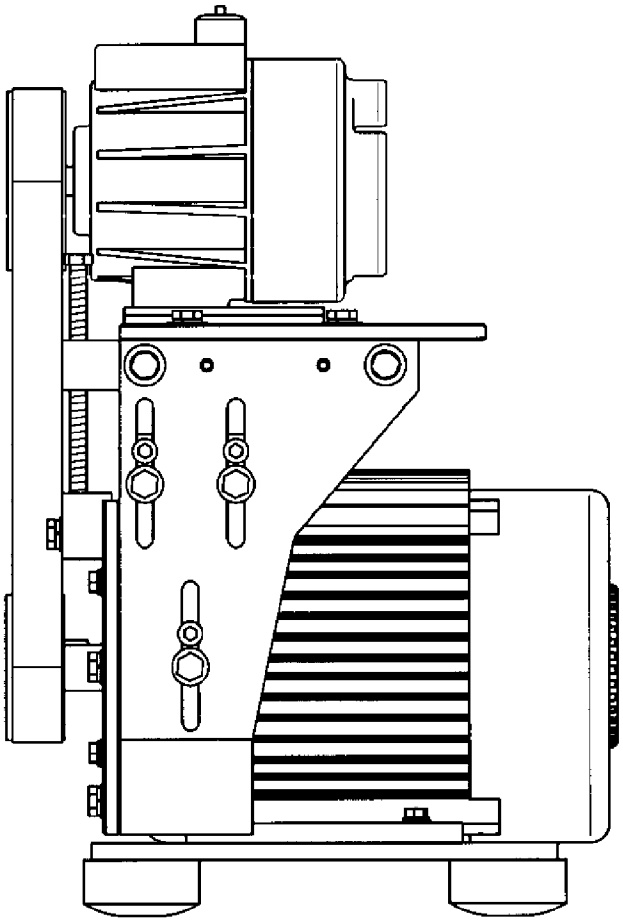
FIG. 9 is a right side view of the assembly of FIG. 5.
Figure 11:
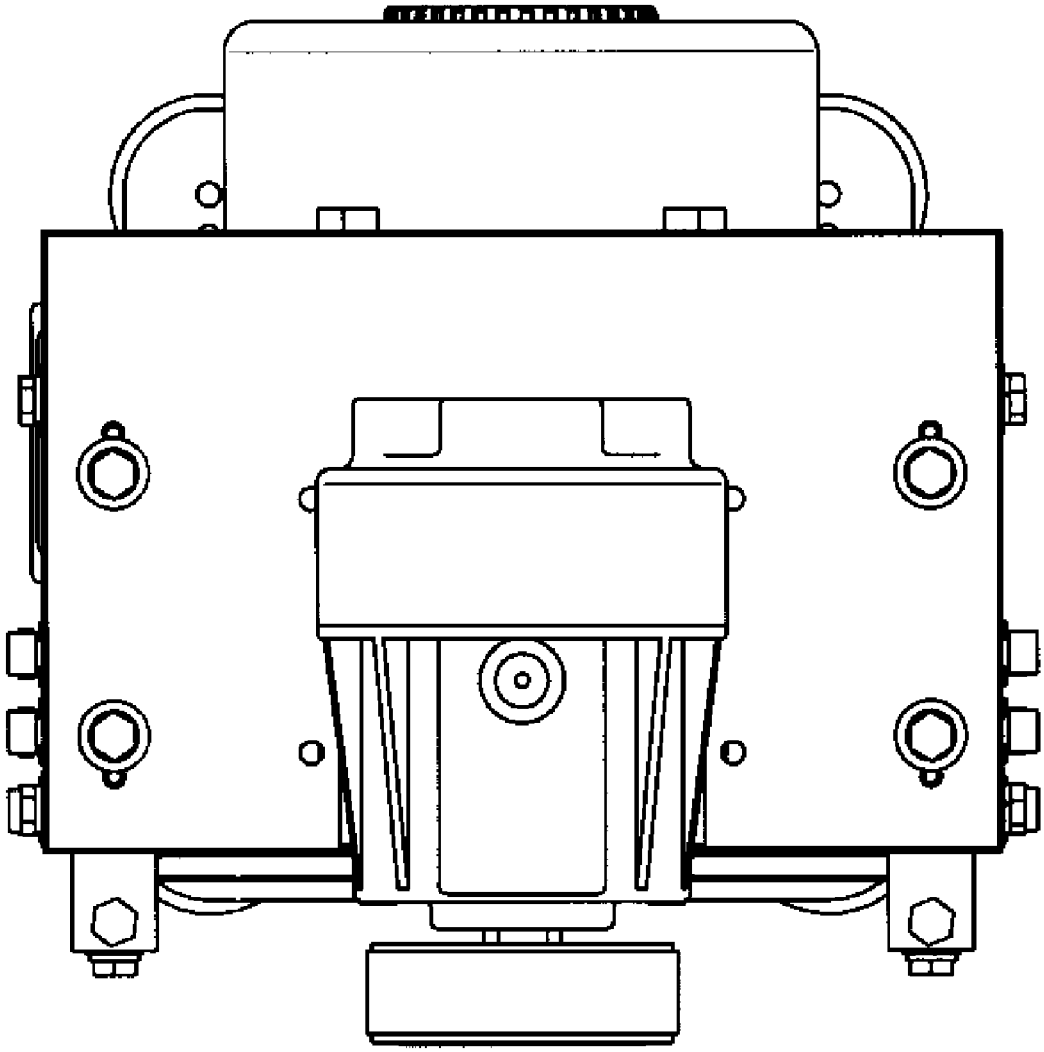
FIG. 11 is a top plan view of the assembly of FIG. 5.
Figure 13:
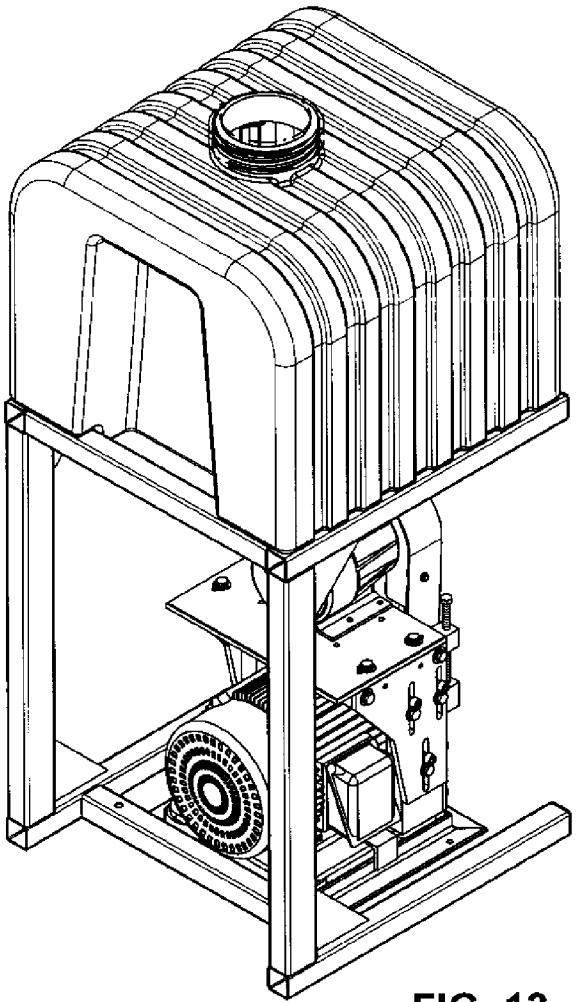
FIG. 13 is a rear perspective view of the pump station of FIG. 12.
Figure 12:
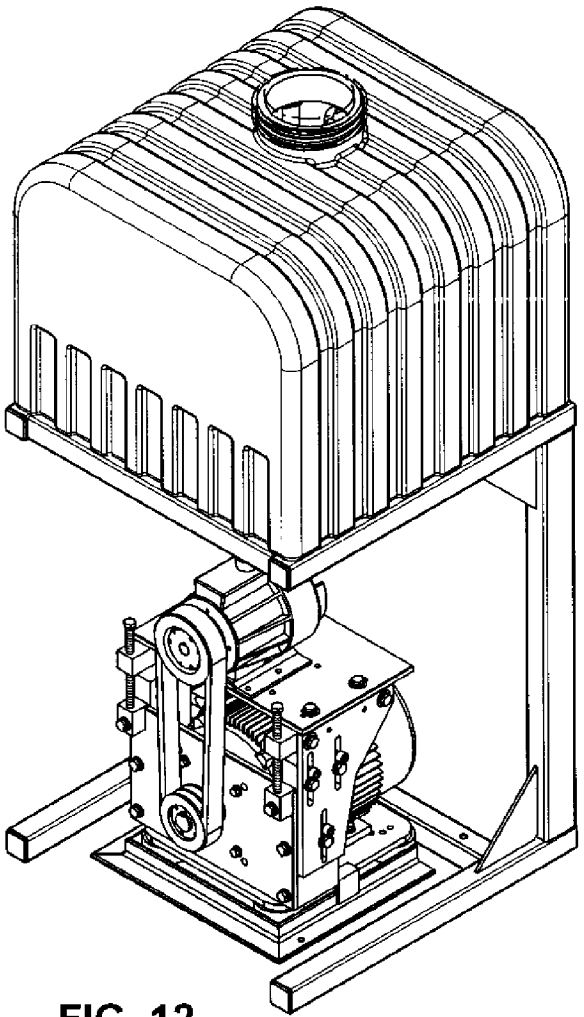
FIG. 12 is a front perspective view of a pump station.
Figure 15:
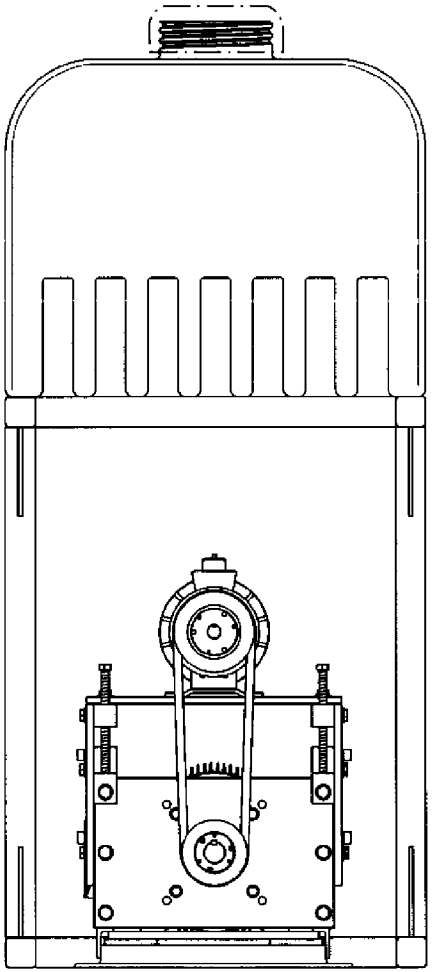
FIG. 15 is a front view of the pump station of FIG. 12.
Figure 14:
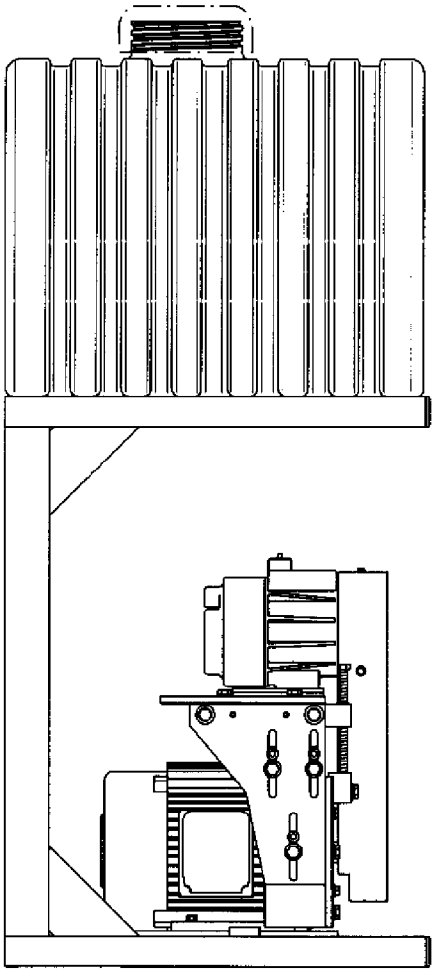
FIG. 14 is left side view of the pump station of FIG. 12.
Figure 18:
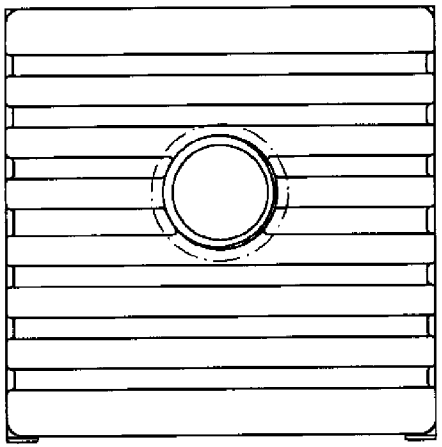
FIG. 18 is a top plan view of the pump station of FIG. 12.
Figure 17:
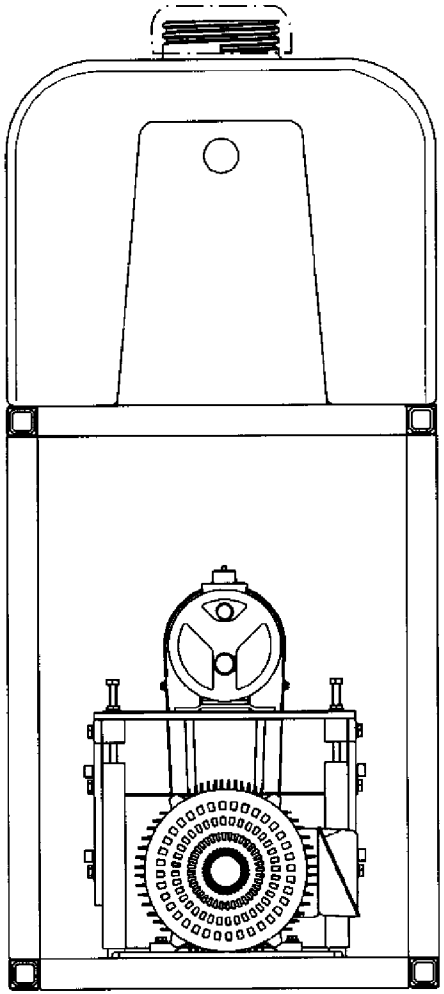
FIG. 17 is a rear view of the pump station of FIG. 12.
Figure 16:
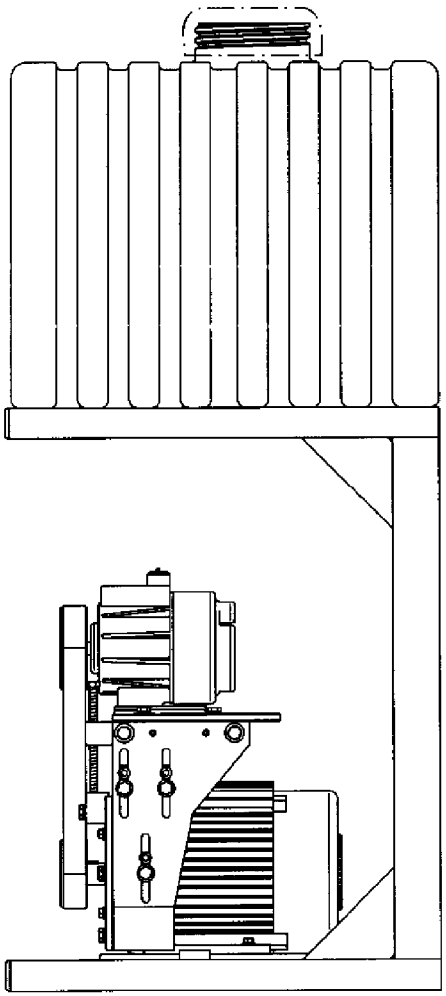
FIG. 16 is a right side view of the pump station of FIG. 12
Figure 20:
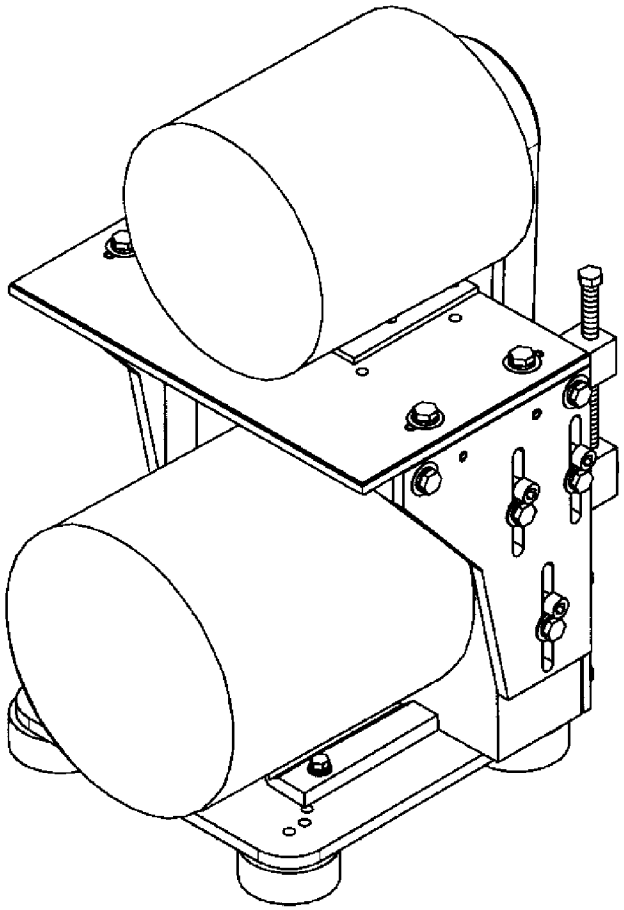
FIG. 20 is a rear perspective view of the assembly of FIG. 19.
Figure 19:
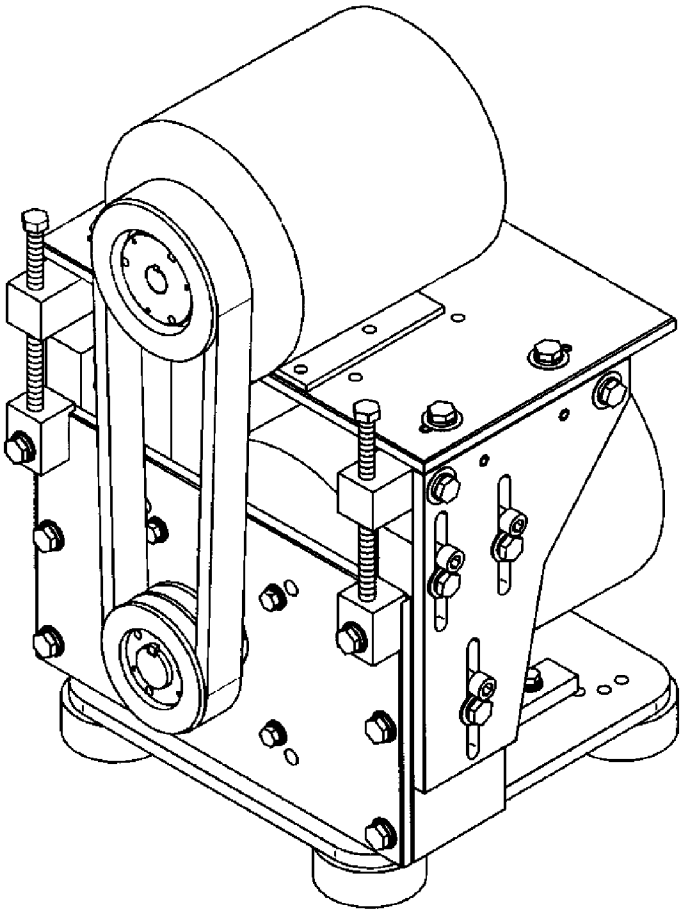
FIG. 19 is a front perspective view of another motor and pump assembly.
Figure 22:
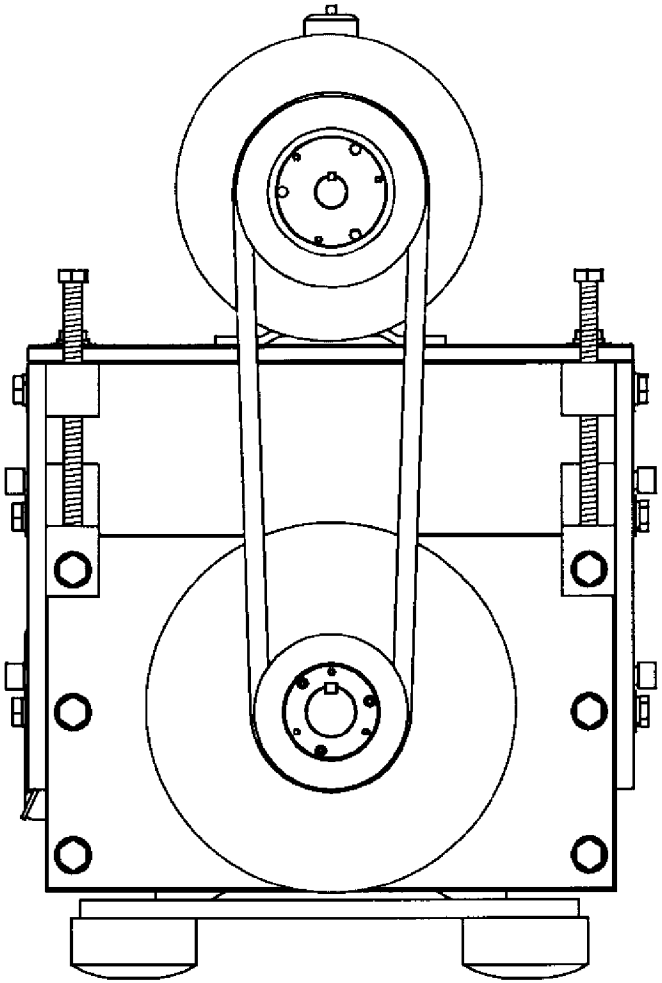
FIG. 22 is a front view of the assembly of FIG. 19.
Figure 21:
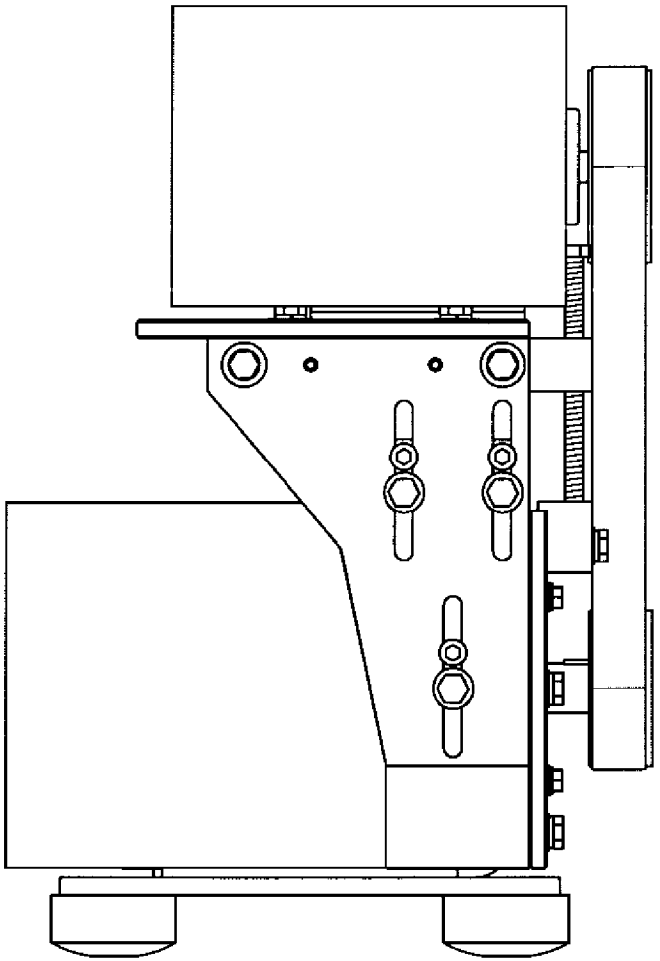
FIG. 21 is left side view of the assembly of FIG. 19.
Figure 24:
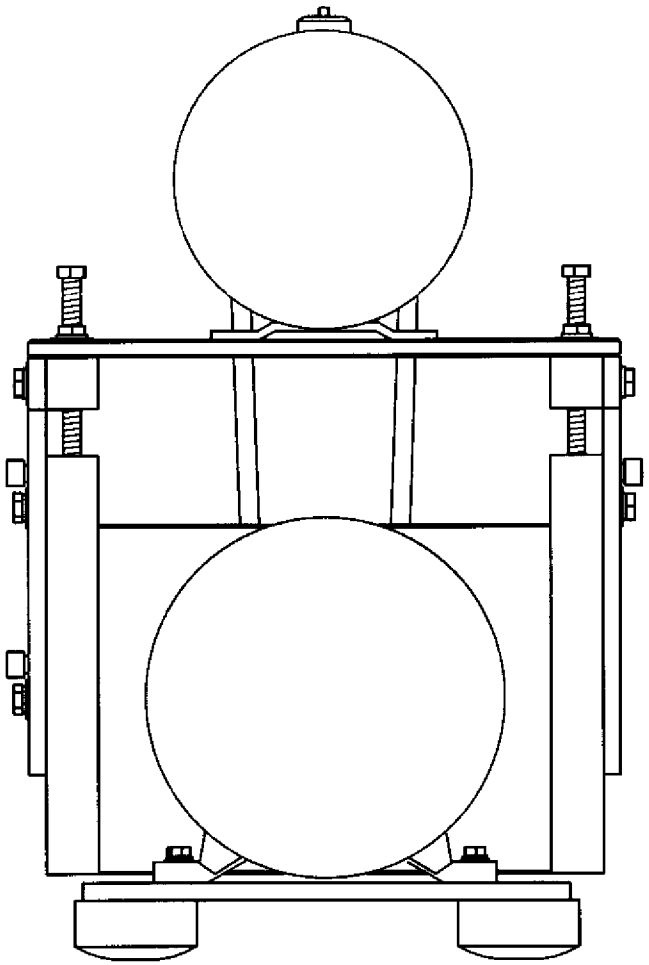
FIG. 24 is a rear view of the assembly of FIG. 19
Figure 23:
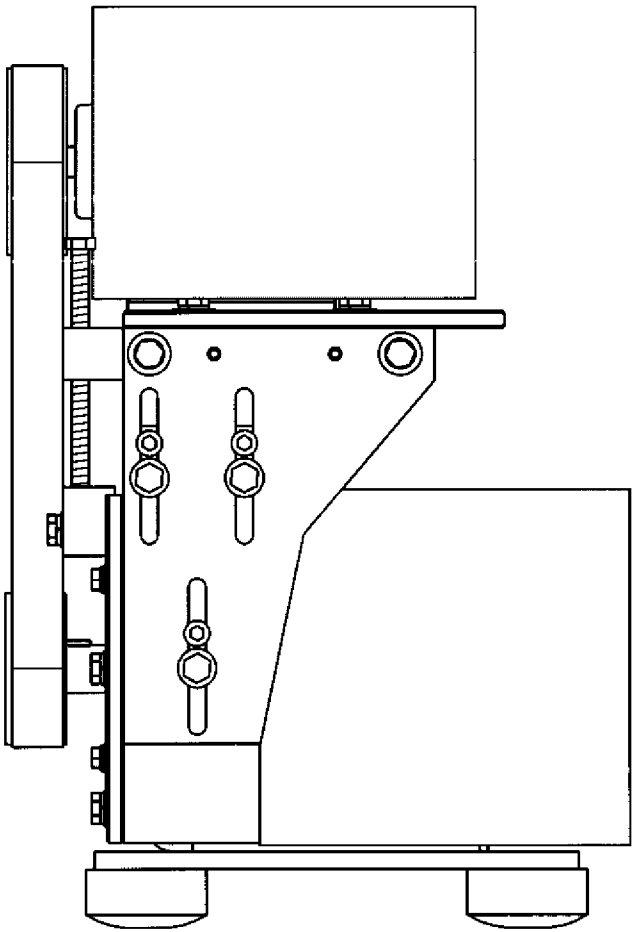
FIG. 23 is a right side view of the assembly of FIG. 19.
Figure 25:
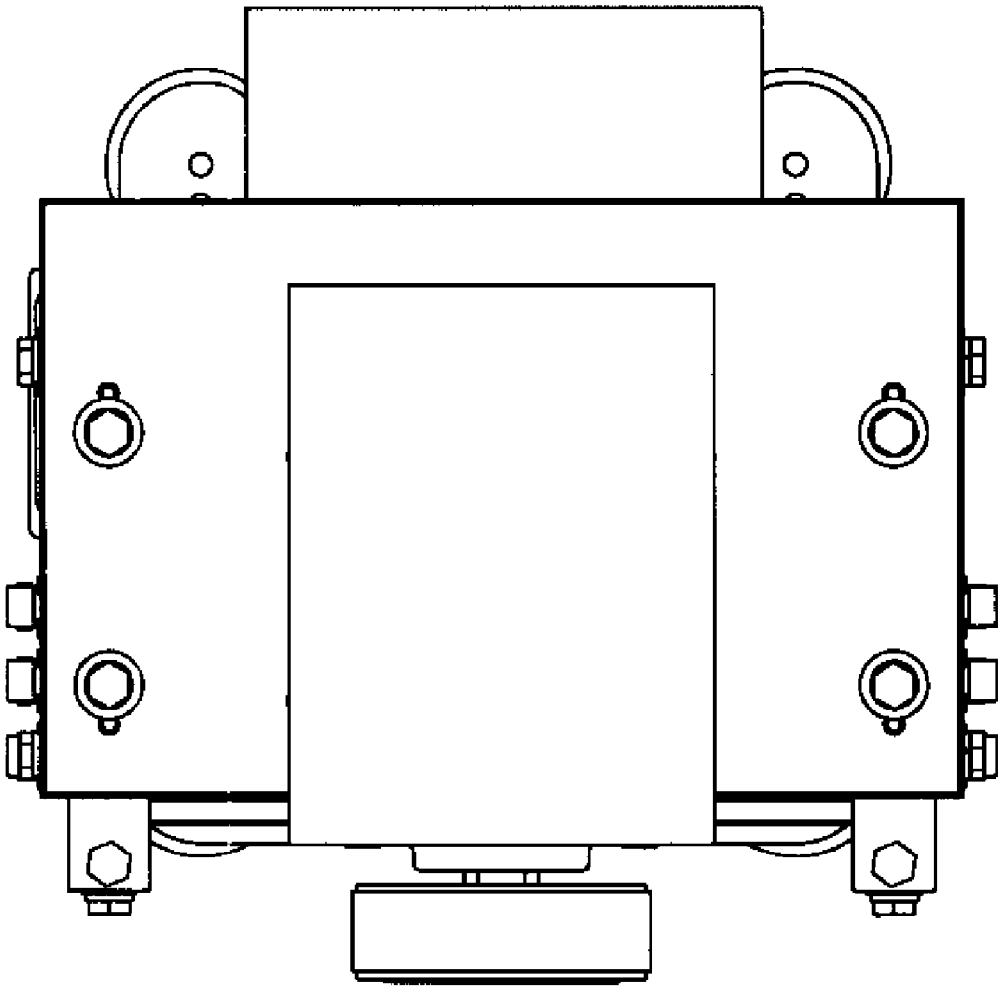
FIG. 25 is a top plan view of the assembly of FIG. 19.

With reference to FIGS. 2, 3 and 4, motor 20 may be a known type of motor, such as a conventional electric motor or a combustion engine motor. An example of a suitable type of electric motor for a vehicle wash system is a model 15 HP TEFC, CROWN SIGNATURE HIGH EFFICIENCY MOTOR made by HYUNDAI.

Motor 20 may be securely mounted with several mount bolts 23 on a support plate 24 which may be made from a suitable material for the specific application such as by way of example only, steel, aluminium, stainless steel to name only a few materials. The support plate 24 may simply rest on the floor or may be secured to a support frame or plate, but in both cases can be supported primarily by shock absorbing feet members 26. Feet members 26 may be made from resilient rubber or other suitable material. The entire weight, or substantially all of the weight of the motor 20 and pump 22, along with the mounting assembly described below, may be carried on feet 26.

Motor 20 has a rotatable drive shaft 21 such that when motor 20 is operated, it can cause the shaft to rotate to exert a rotational force on a pulley 25 mounted thereon to turn the pulley 25, even when the pulley is under a load. Drive shaft 21 has a central longitudinal axis X2-X2 about which it rotates. The operation of the motor 20 can be controlled by any suitable control means such a simple manual on/off switch, or a suitable control mechanism which may be part of a vehicle wash system Programmable Logic Controller (PLC).

Pump 22 may be any suitable pump for pumping a fluid, liquid or gas (including air) depending upon the particular application. An example of a suitable type of pump 22 for a vehicle wash system is a model H25E made by WANNER ENGINEERING HYDRACELL PUMP which may be suitable for pumping a liquid such as reclaimed water to deliver the liquid under relatively high pressure such as by way of example only, 1000 PSI to where it is desired in the vehicle wash system.

Pump 22 has a drive shaft 50, which is interconnected to an internal impeller (not shown). Thus, when drive shaft 50 is rotated by application of a torque/force, liquid fed into inlet 130 of pump 22 will be pumped out under pressure through outlet 131 (FIG. 3).

Affixed to the drive shaft 50 of pump 22 is a pulley 52. Drive belt/chain 60 interconnects pulley 25 of motor 20 with pulley 52, to provide a drive mechanism such that rotation of pulley 25 by drive shaft 21 of motor 20, is transmitted to and causes rotation of pulley 52 and shaft 50 of pump 22, thus driving the pump impeller. Belt 60 and pulleys 25 and 52 may be provided with a cover 121.

It should be noted that pulleys 52 and 25 do not have to have the same outer diameter such that they have the same speed of angular rotation.

It is important that the axes X1-X1 of pump 22 remain parallel (or at least substantially parallel within very small tolerances) to axis X2-X2 of motor 20. Failure to maintain substantial parallel alignment of these axes can put significant wear and strain on the pump and motor drive shafts, thus potentially resulting in premature failure. Additionally, there can be undue wear on the belt 60.

It will be appreciated that belt 60 will be under significant tension in order to ensure that there is sufficient ability of the motor to drive the shaft of the pump 22 without slippage. However, in known adjustment systems there is a possibility of the shaft 21 and shaft 50 being drawn towards each other as a result of the belt tension. However, given where the load is being applied by the belt 60, this can result in mis-alignment as axes X2-X2 and X1-X1 move out of parallel orientation to each other as one or both of the motor 20 and pump 22 rotate relative to their aligned positions. As disclosed hereinafter, a pump mounting assembly 28, may allow for adjustment of the belt tension, without the risk of the shafts 21, 50 becoming misaligned from their desired parallel orientation.

Aside from the misalignment of the shafts 21 and 50 that occurs when one or both of the motor and pump are rotated, the shafts 21 and 50 in the illustrated embodiment of FIGS. 2-4, can only be translated in the direction of the plane P (see FIG. 2) passing through the intersection of the axes of both shafts.

Pump 22 may be securely mounted above the motor 20 by using mounting assembly generally designated 28. In the disclosed embodiment, the plane P that passes through shafts 21 and 50 may be oriented in the vertical direction relative to the ground. Therefore, shaft 50 may be mounted directly vertically above shaft 21.

Mounting assembly 28 may include a lower assembly portion 30 and an upper assembly portion 34. As will be explained hereafter, upper assembly portion 34 and lower assembly portion 30 can be displaced vertically relative to each other using an adjustment mechanism and axis X1-X1 and axis X2-X2 may remain in plane P. The components of upper and lower mounting assembly portions 30 and 34 may be made from a suitable material for the specific application such as for example steel, aluminium and stainless steel to name only a few materials.

Pump 22 is mounted with several mount bolts 41 on a support plate 44, which forms part of the upper assembly portion 34. Support plate 44 may be oriented in a generally horizontal plane that may be parallel to axis X1-X1. However the important aspect is that when mounted with mounting assembly 28, the axis X1-X1 will be parallel to axis X2-X2. Also as part of upper assembly portion 34, support plate 44 has at opposite side edges, longitudinally extending support blocks 47*a*, 47*b* affixed thereto with bolts 42. Also mounted to side faces of support blocks 47*a*, 47*b* are opposed vertical outer plate members 46*a*, 46*b*. Each of plates 46*a*, 47*a*, has a plurality of spaced vertically extending slots 80 therethrough.

Lower assembly portion 30 may include a transverse and vertically oriented plate member 70. Such a plate 70 can, with bolts 72 received in bolt holes 41 be mounted securely to the front transverse face 39 of motor 20. Thus while the lower assembly 30 might in other embodiments be mounted to other parts of motor 20, mounting to front face 39 of motor 20 provides significant benefits. Since face 39 will in some motor embodiments be configured to be orthogonal to axis X2-X2 of shaft 21, it makes the configuration and mounting of the entire mounting assembly easier to ensure that axis X1-X1 is parallel to axis X2-X2.

Shaft 21 will thus protrude through an opening 73 in plate 70 and thus is freely rotatable in relation thereto. Secured to plate 70 with bolts 75 are opposite inner vertical block members 77*a*, 77*b*. Extending outwardly from the face of blocks 77*a*, 77*b* are guide rods 79 which are received through slots 80. Guide rods have heads which are used to ensure that the rods 79 are maintained in slots 80.

It will be appreciated that blocks 77*a*, 77*b* can only move in sliding relation to vertical plates 46*a*, 46*b* in the direction permitted by the movement of rods 79 in slots 80. The axes of movements of each slot 80 Z1, Z-2 and Z3 (FIG. 4) are each parallel to each other but are also oriented to be orthogonal to the axes X1-X1 and X2-X2 of the shafts. Thus, any movement of shaft 50 and shaft 21 relative to each other will 0be constrained by the movement of rods 79 in slots 80, thus maintaining the alignment of shafts 50 and 21 in parallel relation to each other.

It will be appreciated that to ensure that the movement of the upper assembly 34 relative to the lower assembly 30 will be translation in only one desired direction orthogonal to axes X1-X1, X2-X2, with no rotation of the upper assembly relative to the lower assembly in any direction, it will be necessary to provide for more than one slot and rod combination. The three slots and rods combination shown in FIGS. 2-4 is however, only one such possible combination.

It will also be appreciated that the entire mounting assembly 28 as well as the pump 22, are vertically supported by the connection between the transverse plate 70 of the lower assembly portion 30 and the front plate 39 of the motor. In other words, the mounting assembly 28 and pump 22 are not otherwise supported in any significant way other than by the connection to the motor 20 (i.e. the assembly and pump "hang off" the front face of the motor.) This arrangement assists in isolating the movement of the pump relative to the motor, along with their respective shafts.

Also as part of lower assembly portion 30 are blocks 99*a*, 99*b* attached respectively to plates 77*a*, 77*b* with bolts 97*a*, 97*b*. Blocks 99*a*, 99*b* receive the end of a threaded bolt member 98*a*, 98*b* in an aperture 95*a*, 95*b* and are free to rotate therein. However the ends of the bolt members 98*a*, 98*b* will remain situated in the apertures 95*a*, 95*b* during rotation thereof.

The upper ends of bolts 98*a*, 98*b* are received through complimentary threaded apertures 101*a*, 101*b* in longitudinally extending block members 47*a*, 47*b* respectively. Therefore, when threaded bolt members are rotated by nuts 103*a*, 103*b*, this will cause blocks 47*a*, 47*b* to move vertically up or down, thus plates 46*a*, 46*b* to move up or down, but the movement being constrained in the completely vertical orientation parallel to axes Z1, Z2 and Z3. Accordingly, the entire upper assembly portion 34 can be translated up or down relative to lower assembly portion 30 as the axis XI-XI only moves in plane P.

Since the pump 22 is fixedly mounted to the upper assembly portion 34, which is itself rigid, and since the lower assembly portion 30 is securely attached to the front face of the motor, so long as the motor shaft 21 is initially oriented parallel to shaft 50 of pump 22, then the only possible significant movement will be the translation vertical movement of upper assembly portion 34 relative to lower assembly portion 30 which is controlled by the guide rods 79 which slide in slots 80. The slots can, as illustrated, be oriented so that the movement of the axis X1-X1 is maintained in the plane P, as the upper assembly portion's vertical position is adjusted.

It should be noted also that bolts 75 are also received through slots 80 and bolts 75 are used to assist in securing the upper assembly portion in a fixed vertical spacing relative to lower assembly portion 30 during operation of the pump station. Bolts 75 are secured into inner plates 77*a*, 77*b*. Turning the bolts 75 will either tighten or loosen bolts 75 such that plates 46*a*, 46*b* will either be pulled up tightly against plates 77*a*, 77*b* to secure the relative position of plates 77*a*, 77*b* relative to plates 46*a*, 46*b*, or the plates 46*a*, 46*b* will be slackened off to permit the plates 46*a*, 46*b* to slide upwards or downwards relative to plates 77*a*, 77*b* when the threaded bolts 98*a*, 98*b* are turned.

In use, when it is desired to either change the belt 60, or change the tension on the belt 60, the bolts 75 can be loosened so that the threaded bolts 98*a*, 98*b* can be turned to adjust the relative positions of upper assembly 34 and lower assembly 30. When the desired vertical separation of shaft 21 and 50 is obtained, then bolts 75 can be re-tightened to secure the plates 46*a*, 46*b* in fixed vertical relation to plates 77*a*, 77*b*.

In some alternate example embodiments, the positions of the motor and pump can be interchanged, such that the mounting assembly is mounted to the front face of the pump.

In other example embodiments, the pump is not mounted directly vertically above the motor. In some such embodiments, the upper assembly portion will still move vertically upwards relative to the lower assembly portion, even though the axis X1-X1 does not remain in a plane P FIGS. 5-25 also illustrate design features of pump station and pump/motor arrangements in accordance with other aspects of the invention.

The foregoing relates to only exemplary embodiments of the invention, it being understood that numerous other modifications, variants, embodiments and changes are possible within the scope and spirit of the invention.

The invention claimed is:

1. A motor and pump arrangement comprising:

a. a motor having a drive shaft rotatable about a first longitudinal axis;

b. a pump having a drive shaft rotatable about a second longitudinal axis oriented parallel to said first longitudinal axis;

c. a drive mechanism interconnecting said drive shaft of said motor and said drive shaft of said pump;

d. a mounting assembly comprising i. a lower portion mounted to a front face portion of one of said motor and said pump;

ii. an upper portion to which said other of said motor and said pump is mounted, said lower portion and said upper portion being selectively moveable relative to each other only in a translation direction that is orthogonal to the direction of said first and second axis, and said upper and lower portions being restrained from any rotational movement relative to each other wherein one of said upper portion and said lower portion has opposed plates each comprising at least first and second spaced slots each oriented in said orthogonal direction, and said other of said upper portion and said lower portion comprises corresponding first and second rods receivable in each of said slots, said rods being movable within said slots such that said upper portion only moves relative to said lower portion in said orthogonal direction.

2. A motor and pump arrangement comprising:

a. a motor having a drive shaft rotatable about a first longitudinal axis;

b. a pump having a drive shaft rotatable about a second longitudinal axis oriented parallel to said first longitudinal axis;

c. a drive mechanism interconnecting said drive shaft of said motor and said drive shaft of said pump;

d. a mounting assembly comprising i. a lower portion mounted to a front face portion of one of said motor and said pump;

ii. an upper portion to which said other of said motor and said pump is mounted, said lower portion and said upper portion being selectively moveable relative to each other only in a translation direction that is orthogonal to the direction of said first and second axis, and said upper and lower portions being restrained from any rotational movement relative to each other wherein, said upper portion comprises a generally horizontally oriented plate with first and second opposed side plate members extending vertically downwardly therefrom;

said lower portion comprises a transverse and vertically oriented plate mounted to said front face portion of said one of said motor and said pump, said lower portion having first and second opposed side plate members extending vertically upward therefrom in overlapping relation to said first and second opposed side plate members of said upper portion;

said upper portion and said lower portion co-operating to provide selective sliding relation of said first and second opposed side plate members of said upper portion in relation to said first and second opposed side plate members of said lower portion so as to provide translation movement only in said orthogonal direction.

3. An arrangement as claimed in claim 2 wherein said pump is fixedly mounted to said plate of said upper portion.

4. An arrangement as claimed in claim 3 further comprising an adjustment mechanism for selectively adjusting the relative positions of said upper and lower portions in said orthogonal directions.

5. An arrangement as claimed in claim 1 wherein during said movement in said orthogonal direction said axes continue to lie in a plane passing through the intersection of said axes.

6. An arrangement as claimed in claim 1 wherein said orthogonal direction is substantially vertical, and said other of said motor and said pump is mounted substantially vertically above said one of said motor and said pump.

7. An arrangement as claimed in claim 1 wherein said pump is mounted to said upper portion and said motor is mounted to said lower portion.

8. An arrangement as claimed in claim 1 wherein said drive mechanism comprises said drive shaft of said motor comprising a first pulley mounted for rotation therewith, and said drive shaft of said pump comprising a second pulley mounted for rotation therewith, and said arrangement further comprises a belt interconnecting said first pulley and said second pulley such that said drive shaft of said motor can rotate said drive shaft of said pump.

9. An arrangement as claimed in claim 7 wherein said lower portion comprises a transversely oriented plate member secured to said front face of said motor.

10. A motor and pump arrangement comprising;

a. a motor having a drive shaft rotatable about a first longitudinal axis;

b. a pump having a drive shaft rotatable about a second longitudinal axis oriented parallel to said first longitudinal axis;

c. a drive mechanism interconnecting said drive shaft of said motor and said drive shaft of said pump;

d. a mounting assembly comprising:

i. a lower portion mounted to a portion of one of said motor and said pump;

ii. an upper portion to which said other of said motor and said pump is mounted;

said lower portion and said upper portion being configured and selectively movable in such a manner that said drive shaft of said motor and said drive shaft of said pump during translation movement relative to each other, are constrained from rotational movement relative to each other, wherein, said upper portion comprises a generally horizontally oriented plate with first and second opposed side plate members extending downwardly therefrom;

said lower portion comprises a transverse plate oriented orthogonally to said first and second axes, and said transverse plate being mounted to a front face portion of one of said motor and said pump, said lower portion having first and second opposed side plate members extending upward therefrom in overlapping relation to said first and second opposed side plate members of said upper portion;

said upper portion and said lower portion co-operating to provide selective sliding relation of said first and second opposed side plate members of said upper portion in relation to said first and second opposed side plate members of said lower portion so as to provide translation movement only in said orthogonal direction.

11. An arrangement as claimed in claim 10 wherein said pump is fixedly mounted to said plate of said upper portion.

12. An arrangement as claimed in claim 11 further comprising an adjustment mechanism for selectively adjusting the relative positions of said upper and lower portions in said orthogonal directions.

* * * * *